US007429971B2

(12) United States Patent
Park

(10) Patent No.: US 7,429,971 B2
(45) Date of Patent: Sep. 30, 2008

(54) LIQUID CRYSTAL DISPLAY AND A DRIVING METHOD THEREOF

(75) Inventor: Jun-Ho Park, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 662 days.

(21) Appl. No.: 10/980,686

(22) Filed: Nov. 2, 2004

(65) Prior Publication Data

US 2005/0253796 A1 Nov. 17, 2005

(30) Foreign Application Priority Data

May 17, 2004 (KR) ..... 10-2004-0034678

(51) Int. Cl.
*G09G 3/36* (2006.01)

(52) U.S. Cl. ..... 345/89; 345/50; 345/55; 345/690; 345/691

(58) Field of Classification Search ..... 345/89, 345/50, 55, 690–691
See application file for complete search history.

(56) References Cited

U.S. PATENT DOCUMENTS 6,304,239 B1 10/2001 McKnight
6,567,063 B1 5/2003 Okita
7,084,577 B2 * 8/2006 Maede et al. ..... 315/169.4
2003/0098836 A1 5/2003 Takei

FOREIGN PATENT DOCUMENTS

CN 1232243 A 10/1999
EP 0 949 605 A1 10/1999
JP 2003-345314 * 3/2003

OTHER PUBLICATIONS

European Search Report for application No. 04090445.0, dated Jun. 28, 2005, in the name of Samsung SDI Co., Ltd.

* cited by examiner

*Primary Examiner*—Richard Hjerpe
*Assistant Examiner*—Leonid Shapiro
(74) *Attorney, Agent, or Firm*—Christie, Parker & Hale, LLP

(57) ABSTRACT

A liquid crystal display and a driving method thereof. Liquid crystal is disposed between a first substrate and a second substrate, and first, second, and third color lights are sequentially transmitted for each of a plurality of pixels. A first voltage corresponding to first gray data is applied to a first said pixel, and a second voltage corresponding to second gray data is applied to a second said pixel. A first reset voltage corresponding to the first gray data is applied to the first said pixel after applying the first voltage, and a second reset voltage is applied to the second pixel after applying the second voltage. The second reset voltage corresponds to the second gray data and has a voltage level which is different from that of the first reset voltage.

21 Claims, 13 Drawing Sheets

LIQUID CRYSTAL DISPLAY AND A DRIVING METHOD THEREOF

CROSS REFERENCE TO RELATED APPLICATION

This application claims priority to and the benefit of Korea Patent Application No. 10-2004-0034678 filed on May 17, 2004 in the Korean Intellectual Property Office, the entire content of which is incorporated herein by reference.

BACKGROUND OF THE INVENTION (a) Field of the Invention

The present invention relates to a liquid crystal display and a driving method thereof. More particularly, the present invention relates to a field sequential driving type liquid crystal display (FS-LCD) and a driving method thereof.

(b) Description of the Related Art

As personal computers and televisions, etc., have become more lightweight and thin, the demand for lightweight and thin display devices has increased. According to such requirements, flat panel displays such as liquid crystal displays (LCD) have recently been developed instead of cathode ray tubes (CRT).

An LCD is a display device used to display a desired video signal by applying electric fields to liquid crystal materials having an anisotropic dielectric constant and injected between two substrates, and controlling the strength of electric fields so as to control an amount of light from an external light source (i.e., backlight) transmitted through a substrate.

The LCD is representative of portable flat panel displays, and TFT-LCDs using a thin film transistor (TFT) as a switching element are mainly used.

Each pixel in the TFT-LCD can be modeled with capacitors having liquid crystal as a dielectric substance, such as a liquid crystal capacitor. An equivalent circuit of each pixel in such an LCD is as shown in FIG. 1.

As shown in FIG. 1, each pixel of a liquid crystal display includes a TFT 10, of which a source electrode and a gate electrode are respectively connected to a data line (Dm) and a scanning line (Sn); a liquid crystal capacitor Cl connected between a drain electrode of the TFT and common voltage Vcom; and a storage capacitor Cst connected to the drain electrode of the TFT.

In FIG. 1, when a scanning signal is applied to a scanning line (Sn) and the TFT 10 is turned on, data voltages (Vd) supplied to the data line are applied to each pixel electrode (not shown) though the TFT. Then, an electric field corresponding to a difference between pixel voltages Vp applied to pixel electrodes and the common voltage Vcom is applied to liquid crystal (which is equivalently shown as the liquid crystal capacitor Cl in FIG. 1). Light transmits with a transmittivity corresponding to the strength of the electric field. In this instance, a pixel voltage Vp needs to be maintained during one frame or one field, so the storage capacitor Cst in FIG. 1 is used to maintain a pixel voltage Vp applied to a pixel electrode.

Generally, liquid crystal display can be classified into two methods, a color filter method and a field sequential driving method, based on methods of displaying color images.

A liquid crystal display of a color filter method has color filter layers composed of three primary colors such as red R, green G, and blue B in one of two substrates, and displays a desired color by controlling an amount of light transmitted through the color filter layer. A liquid crystal display of a color filter method controls an amount of light transmitted through the R, G, and B color filter layers when light from a single light source transmits through the R, G, and B color filter layers, and composes R, G, and B colors to display a desired color.

A liquid crystal display device displaying color using a single light source and 3 color filter layers needs unit pixels respectively corresponding to each R, G, and B subpixel, thus at least 3 times the number of pixels are needed compared with displaying black and white. Therefore, fine manufacturing techniques are required to produce video images of high definition.

Further, there are problems in that separate color filter layers must be formed on a substrate for a liquid crystal display in manufacturing, and the light transmission rate of the color filters must be improved.

On the other hand, a field sequential driving type of liquid crystal display sequentially and periodically turns on each independent light source of R, G, and B colors, and adds synchronized color signals corresponding to each pixel based on the lighting periodic time to obtain full colors. That is, according to a field sequential driving type of liquid crystal display, one pixel is not divided into R, G, and B subpixels, and light of 3 primary colors outputted from R, G, and B back lights is sequentially displayed in a time-divisional manner so that the color images are displayed using an after image effect of the eye.

The field sequential driving method can be classified as an analog driving method and a digital driving method.

The analog driving method establishes a plurality of gray voltages, selects one gray voltage corresponding to gray data from among the gray voltages, and drives a liquid crystal panel with the selected gray voltage to perform gray display with an amount of transmission corresponding to the gray voltage applied.

FIG. 2 shows a driving voltage and amount of light transmission of a conventional liquid crystal display of the analog driving method.

In FIG. 2, the driving voltage is a voltage applied to liquid crystal, and optical transmittivity is transmittivity through the liquid crystal. That is, optical transmittivity refers to a torsion degree of the liquid crystal that allows light to transmit.

Referring to FIG. 2, a driving voltage having a V11 level is applied to the liquid crystal, and light corresponding to the driving voltage having the V11 level transmits through the liquid crystal in the R field period Tr for displaying an R color. A driving voltage having a V12 level is applied to the liquid crystal, and light corresponding to the driving voltage having the V12 level transmits through the liquid crystal in the G field period Tg for displaying a G color. Further, a V13 level driving voltage is applied to the liquid crystal, and an amount of light transmission corresponding to the V13 level is obtained. A desired color image is displayed by combination of R, G, and B lights transmitted respectively during Tr, Tg, and Tb periods.

On the other hand, a digital driving method applies a constant driving voltage to the liquid crystal, and controls the voltage applying time to perform a gray display. The digital driving method maintains a constant driving voltage, and controls timing of a voltage applying state and a voltage non-applying state, so as to control a total amount of light transmitting through the liquid crystal.

FIG. 3 shows a waveform which illustrates a driving method of a liquid crystal display of a conventional digital driving method, and shows a waveform of a driving voltage and optical transmittivity of liquid crystal based on driving data of a predetermined bit.

Referring to FIG. 3, gray waveform data corresponding to each gray is provided with a digital signal having a predetermined number of bits, for example a 7 bit digital signal, and a gray waveform according to 7 bit data is applied to the liquid crystal. Optical transmittivity of the liquid crystal is determined based on the gray waveform applied to perform gray display.

In the conventional field sequential driving method, correct gray is typically not displayed since an effective value response of a desired gray for display (for example, a gray scale of R) is changed by a previous gray display (for example, a gray of G). That is, a pixel voltage Vp actually applied to the liquid crystal is determined by a gray voltage (or a gray waveform) supplied to a present field (for example, an R field) and a gray voltage (or a gray waveform) supplied to the previous field (for example, a B field).

U.S. Pat. No. 6,567,063 ("the '063 patent") discloses a field sequential driving method using a reset pulse to solve the problem of the field sequential driving method in which an effective value response of the desired gray is changed because of a previous gray display.

FIG. 4 shows a field sequential driving method using a reset pulse described in the '063 patent. In FIG. 4, periods (T31~T36) indicate an R field, a G field, and a B field performing gray display for each of R, G, and B.

Referring to FIG. 4, a predetermined voltage (reset voltage) is applied, which is independent of input gray data, and is more than a maximum value of gray data applied during a predetermined time (t31~t36) at the point where each of the periods (T31~T36) is ended. A state of all the liquid crystals is reset to the same state (for example, a black state in which no light can be transmitted, that is, optical transmittivity is 0) at the point where each of the periods (T31~T36) is ended.

Thus, when the liquid crystals are driven by voltages applied with gray data at each period (T31~36), the state of the liquid crystals become the same regardless of previous grays displayed, thus the display period for the present gray is not affected by the previous gray display.

However, according to the '063 patent, since a reset voltage of a constant size and width of more than a maximum value of gray data is always applied regardless of input gray data, there is a problem in that power consumption is increased.

SUMMARY OF THE INVENTION

In the present invention, there is provided a field sequential driving type of liquid crystal display for achieving both a reduction of power consumption and correct gray display so as to solve the problems described above.

According to one aspect of the present invention, a driving method of a liquid crystal display is provided. Liquid crystal is disposed between a first substrate and a second substrate, and first, second, and third color lights are sequentially transmitted for each of a plurality of pixels. The method includes applying a first voltage corresponding to first gray data to a first said pixel, and applying a second voltage corresponding to second gray data to a second said pixel. A first reset voltage corresponding to the first gray data is applied to the first said pixel after applying the first voltage, and a second reset voltage is applied to the second said pixel after applying the second voltage. The second reset voltage corresponds to the second gray data and has a voltage level which is different from that of the first reset voltage.

Further, according to another aspect of the present invention, a driving method of a liquid crystal display is provided. Liquid crystal is disposed between a first substrate and a second substrate, and first, second, and third color lights are sequentially transmitted for each of a plurality of pixels. The method includes applying a first voltage corresponding to first gray data to a first said pixel, and applying a first reset voltage corresponding to the first gray data to the first said pixel after applying the first voltage, to reset a state of the liquid crystal of the first said pixel to a desired state.

Further, according to another aspect of the present invention, a driving method of a liquid crystal display is provided. Liquid crystal is disposed between a first substrate and a second substrate, and first, second, and third color lights are sequentially transmitted for each of a plurality of pixels. The method includes applying a first waveform corresponding to first gray data to a first said pixel, and applying a second waveform corresponding to second gray data to a second said pixel. A first reset waveform corresponding to the first gray data is applied to the first said pixel after applying the first waveform, and a second reset waveform is applied to the second said pixel after applying the second waveform. The second reset waveform corresponds to the second gray data and is different from the first reset waveform.

Further, according to another aspect of the present invention, a driving method of a liquid crystal display is provided. Liquid crystal is disposed between a first substrate and a second substrate, and first, second, and third color lights are sequentially transmitted for each of a plurality of pixels. The method includes applying a first waveform corresponding to first gray data to a first said pixel, and applying a first reset waveform corresponding to the first gray data to the first said pixel after applying the first waveform, to reset a state of the liquid crystal of the first said pixel to a desired state.

Further, according to another aspect of the present invention, a driving method of a liquid crystal display is provided. The liquid crystal display includes a plurality of scan lines, and a plurality of data lines insulated and crossing the scan lines. A plurality of pixels are formed at areas surrounded by the scan lines and the data lines, and include switches coupled to the scan lines and the data lines, respectively, and are arranged in a matrix format. Red, green, and blue lights are sequentially transmitted for each said pixel. The driving method includes transmitting the red, green, and blue lights during a red field, a green field and a blue field, respectively. The red field, the green field, and the blue field each includes a reset period for sequentially driving the scan lines, and applying a reset voltage or a reset waveform corresponding to gray data applied during a previous said field; and a data applying period for sequentially driving the scan lines, and applying a gray voltage or a gray waveform corresponding to gray data.

Further, according to another aspect of the present invention, a liquid crystal display is provided. The liquid crystal display includes a liquid crystal display panel including a plurality of scan lines for transferring scan signals, a plurality of data lines insulated and crossing the scan lines, a plurality of pixels arranged in a matrix format and formed at areas surrounded by the scan lines and the data lines and including switches coupled to the scan lines and the data lines. The liquid crystal display also includes a scan driver for sequentially supplying the scan signals to the scan lines, a gray voltage generator for generating a gray voltage corresponding to gray data, a reset voltage generator for generating a reset voltage corresponding to a gray voltage applied to a previous said pixel, a data driver for supplying the gray voltage and the reset voltage respectively outputted by the gray voltage generator and the reset voltage generator to corresponding said data lines, and a light source for sequentially outputting a first color light, a second color light, and a third color light for each said pixel.

Further, according to another aspect of the present invention, a liquid crystal display is provided. The liquid crystal display includes a liquid crystal display panel including a plurality of scan lines for transferring scan signals, a plurality of data lines insulated and crossing the scan lines, and a plurality of pixels arranged in a matrix format and formed at areas surrounded by the scan lines and the data lines and including switches coupled to the scan lines and the data lines. The liquid crystal display also includes a scan driver for sequentially supplying the scan signals to the scan lines, a gray waveform generator for generating a gray waveform corresponding to gray data, a reset waveform generator for generating a reset waveform corresponding to a gray waveform applied to a previous said pixel, a data driver for supplying the gray waveform and the reset waveform respectively outputted from the gray waveform generator and the reset waveform generator to corresponding said data lines, and a light source for sequentially outputting a first color light, second color light, and a third color light for each said pixel.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
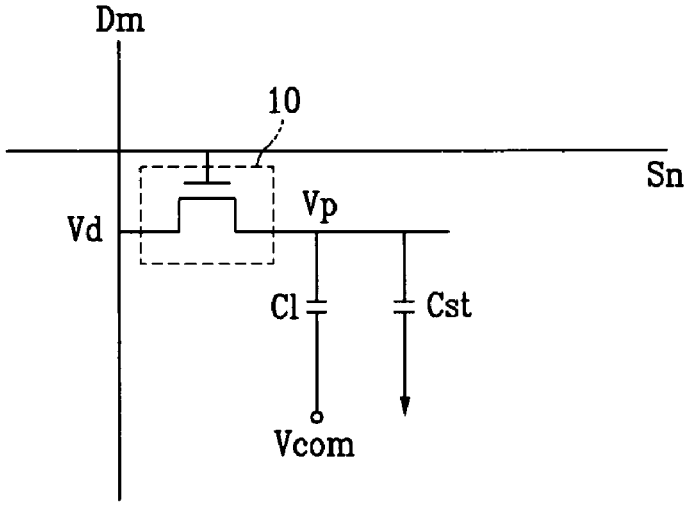
FIG. 1 shows a diagram for a pixel of a conventional TFT-LCD.
Figure 2:
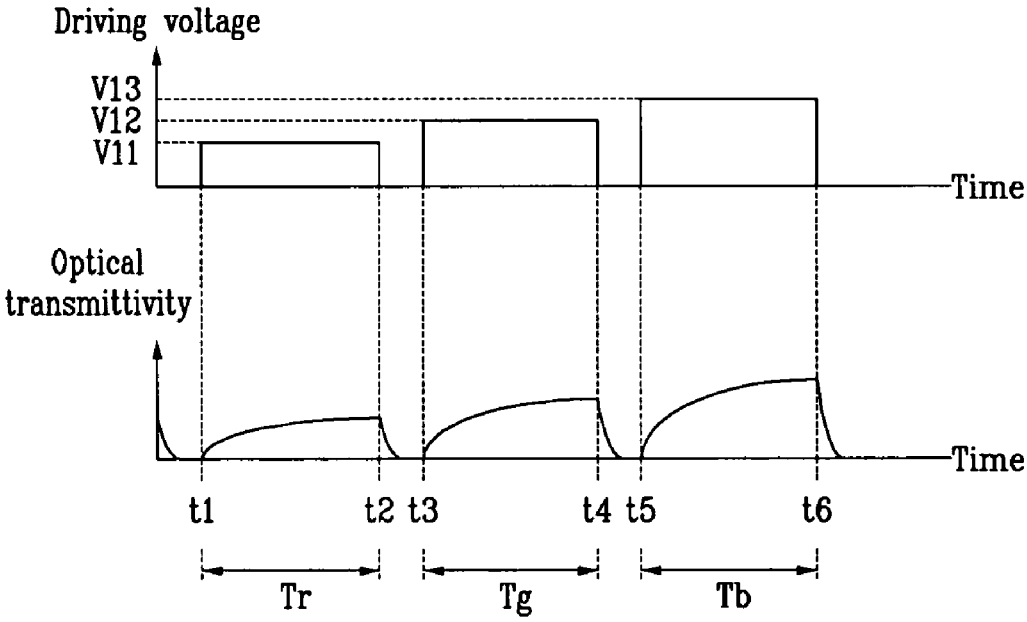
FIG. 2 shows a waveform which illustrates a driving method of a liquid crystal display by a conventional analog method.
Figure 3:
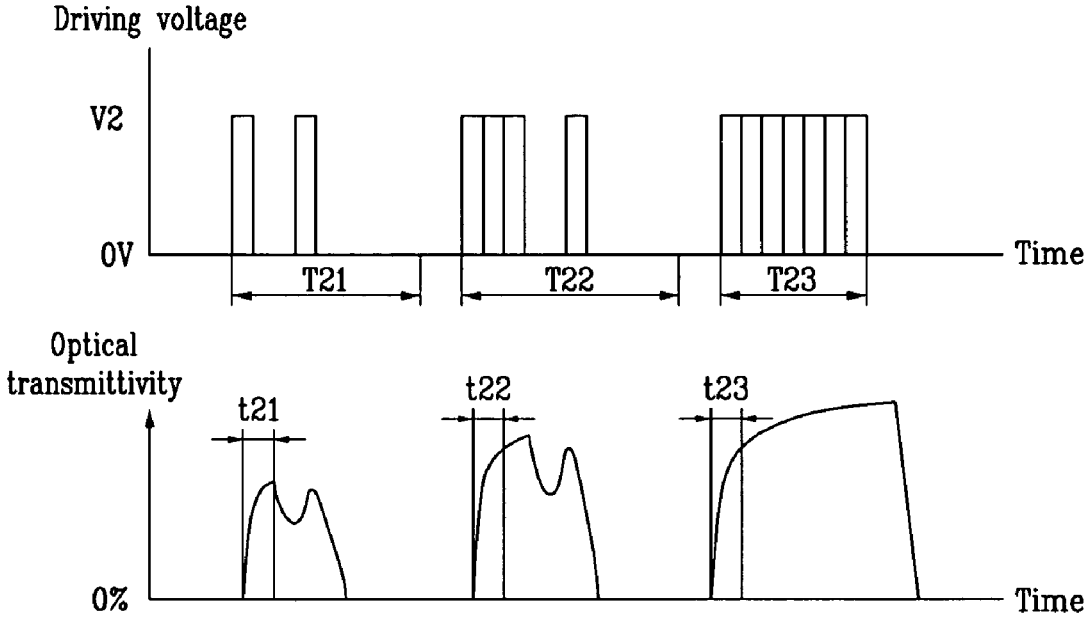
FIG. 3 shows a waveform which illustrates a driving method of a liquid crystal display by a conventional digital method.

In the following detailed description, only certain exemplary embodiments of the present invention are shown and described, simply by way of illustration. As those skilled in the art would realize, the described embodiments may be modified in various different ways, all without departing from the spirit or scope of the present invention. Accordingly, the drawings and description are to be regarded as illustrative in nature, and not restrictive. To clarify the present invention, parts which are not described in the specification may have been omitted. Further, like elements are designated by like reference numerals.

In this specification, "present pixel" refers to a pixel at the present time (t), and "previous pixel" or "previous said pixel" refers to a pixel at the previous time (t−1). "Reset" refers to applying a voltage (or waveform) to make liquid crystal materials in an LCD be in a black state such that light transmission is not allowed. "Gray voltage" and "reset voltage" are voltages having different voltage levels from each other, and "gray waveform" and "reset waveform" are waveforms having different sizes from each other with respect to on-voltage width and off-voltage width. "Optical transmittivity" refers to a ratio of the transmitted light to the applied light, when a constant light is applied to liquid crystal, and an "amount of light transmitted" refers to an amount of light transmitted through the liquid crystal when light is applied.

Figure 5:
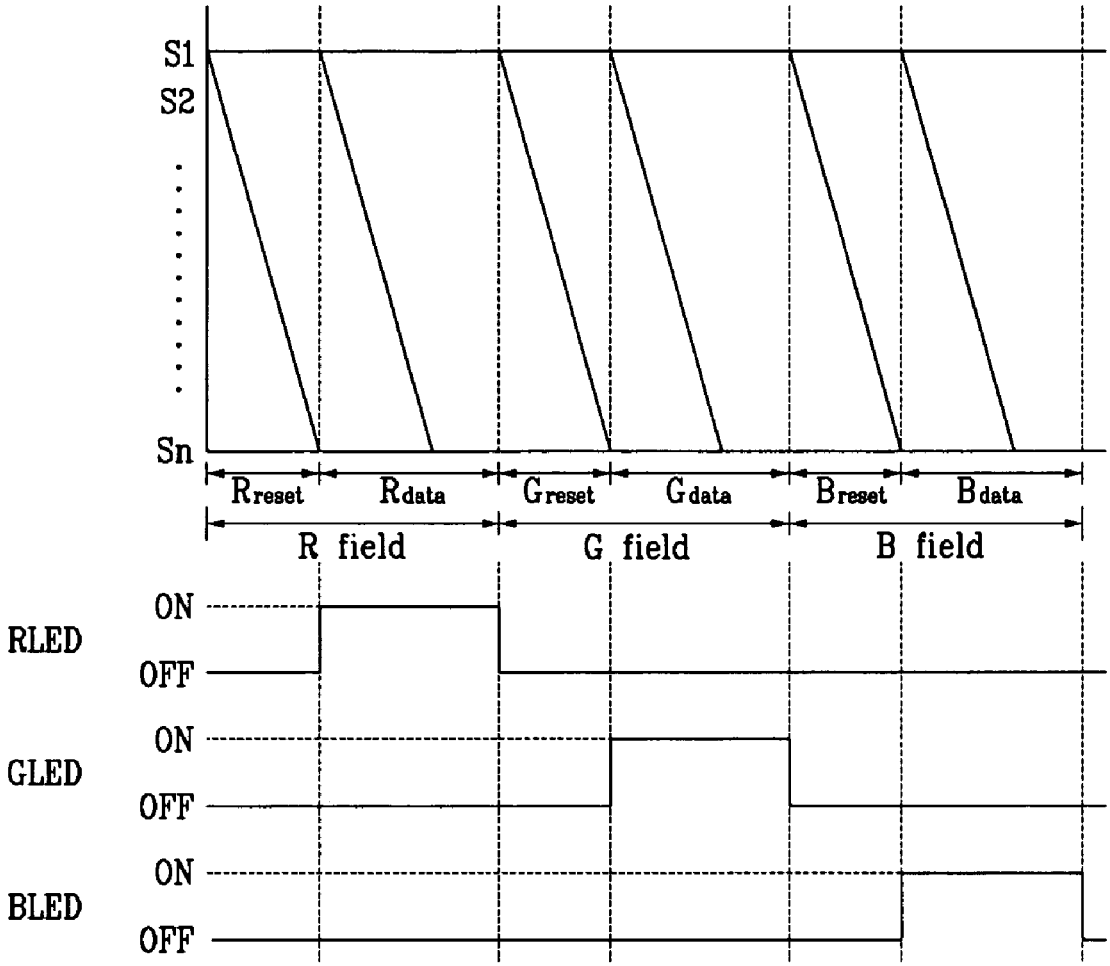
FIG. 5 shows a diagram for a reset driving method according to an exemplary embodiment of the present invention.

FIG. 5 shows a reset driving method according to an exemplary embodiment of the present invention.

As shown in FIG. 5, according to the exemplary embodiment, the R field, G field, and B field display light corresponding to R, G, and B, respectively. The R field, G field, and B field are respectively composed of reset periods Rreset, Greset, and Breset and data periods Rdata, Gdata, and Bdata.

In a reset period, a reset voltage (or a reset waveform) is applied to return a state of the liquid crystals modified by a previously displayed gray to the same state (black state). In the reset periods Rreset, Greset, and Breset of the exemplary embodiment, reset voltages (or reset waveforms) corresponding to previous gray data are sequentially applied to each scan line (S1, S2, . . . Sn) to allow liquid crystals to be in the same state regardless of a previous gray.

In the data periods Rdata, Gdata, and Bdata, gray voltages (or gray waveforms) corresponding to a present gray are applied. Backlights are sequentially turned on during the data period to output light corresponding to R, G, and B. In an exemplary embodiment according to the present invention, an emission diode is used to provide backlighting, by way of example. However, the present invention is not limited to using emission diodes. Instead, any suitable light source may be used to provide backlighting.

Figure 6:
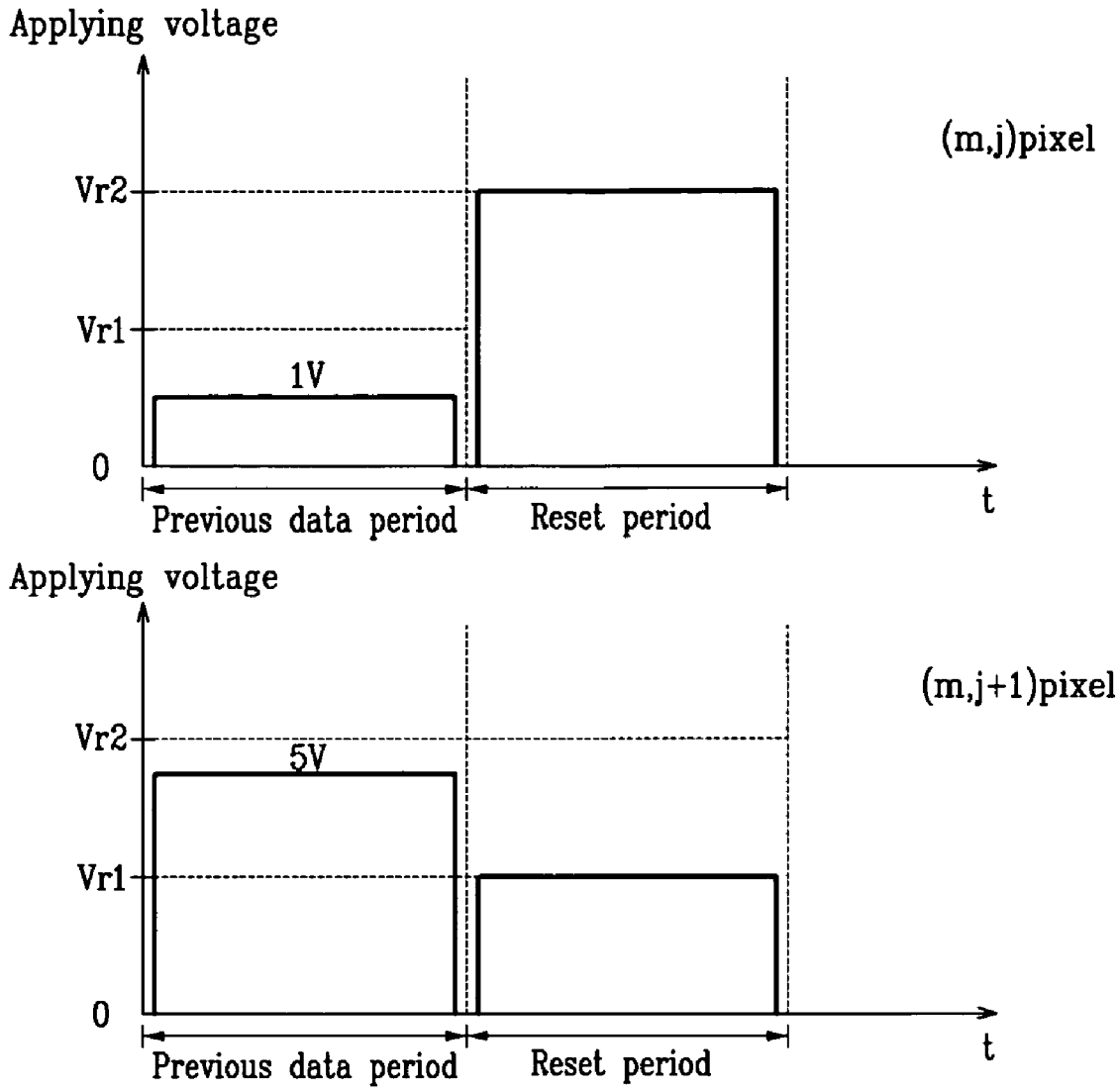
FIG. 6 shows a driving method of a liquid crystal display according to a first exemplary embodiment of the present invention.
Figure 7:
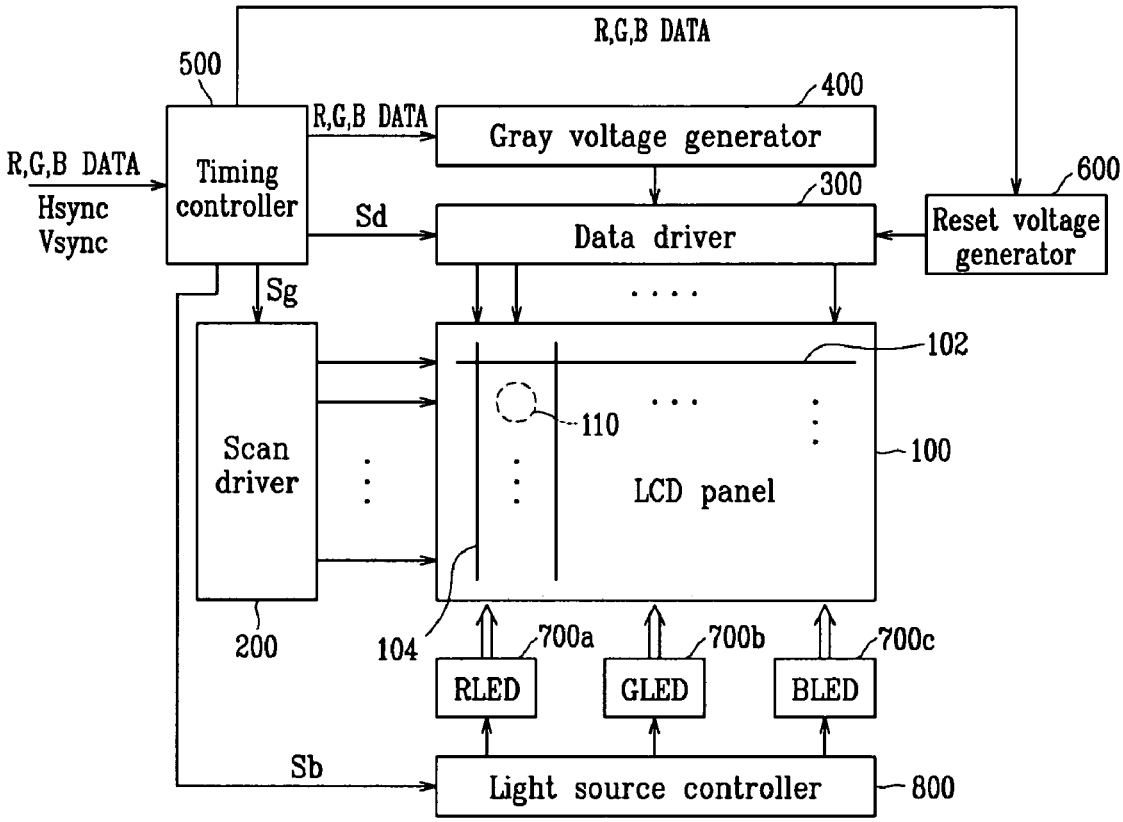
FIGS. 7 and 8 show a liquid crystal display according to the first exemplary embodiment.
Figure 8:
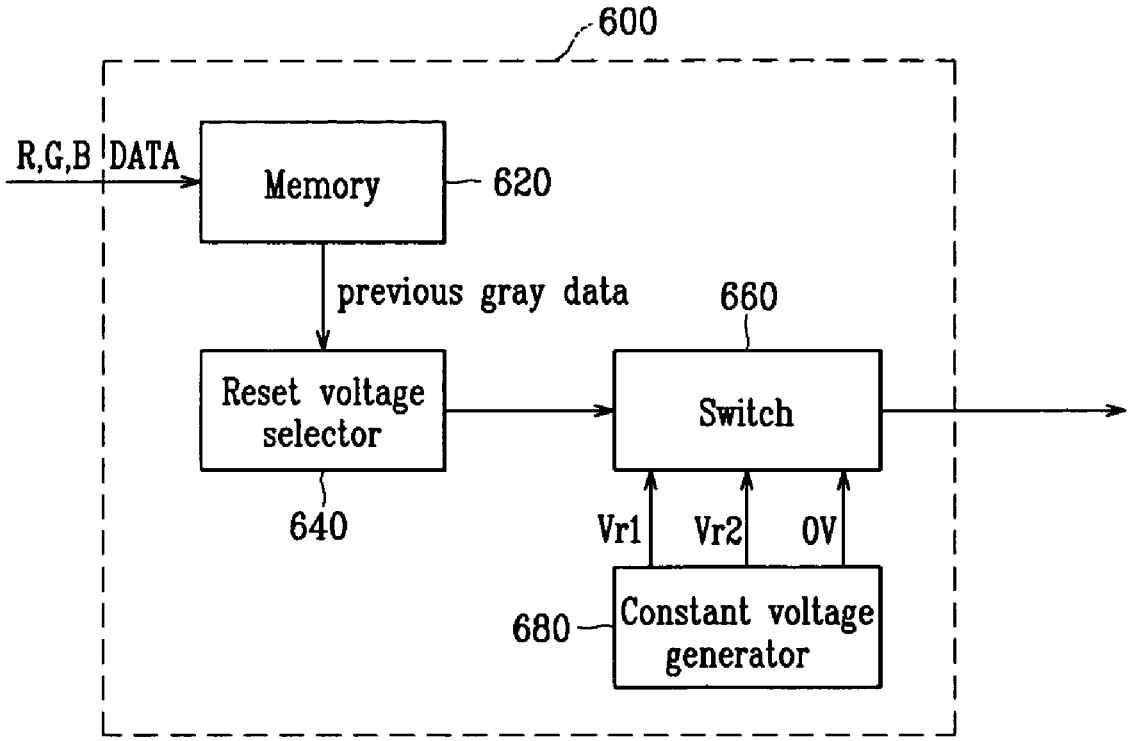

Next, a driving method according to a first exemplary embodiment is explained in reference to FIGS. 6~8. The driving method of the first exemplary embodiment relates to a reset driving method applied to a field sequential driving method of an analog method.

Referring to FIG. 6, a reset voltage (Vr2) applied to an (m,j) pixel (that is, a pixel corresponding to the Dm data line and the Sj scan line) and a reset voltage (Vr1) applied to an (m,j+1) pixel (that is, a pixel corresponding to the Dm data line and the Sj+1 scan line) for displaying a present R light depend on data applied to a previous pixel (for example, a pixel for displaying a B light).

In detail, according to the first exemplary embodiment, in normal white mode, when a relatively low absolute value of voltage (for example, 1V) is applied to a previous pixel, a state of liquid crystal is turned to a state in which a relatively large amount of light can transmit (that is, optical transmittivity is high) at the end of the period for applying a data voltage. Therefore, a relatively large absolute value of reset voltage should be applied to the present pixel. However, when a relatively high voltage (for example, 5 V) is applied to the previous pixel, it is sufficient to apply a relatively small absolute value of reset voltage to the present pixel, since the state of the liquid crystal is turned to a state in which a relatively small amount of light can transmit (that is, optical transmittivity is low) at the end of the period for applying a data voltage. When a large data voltage is applied to a previous pixel so that the state of liquid crystal is almost black at the end of the period for applying the data voltage, the reset voltage may not need to be applied.

Figure 4:
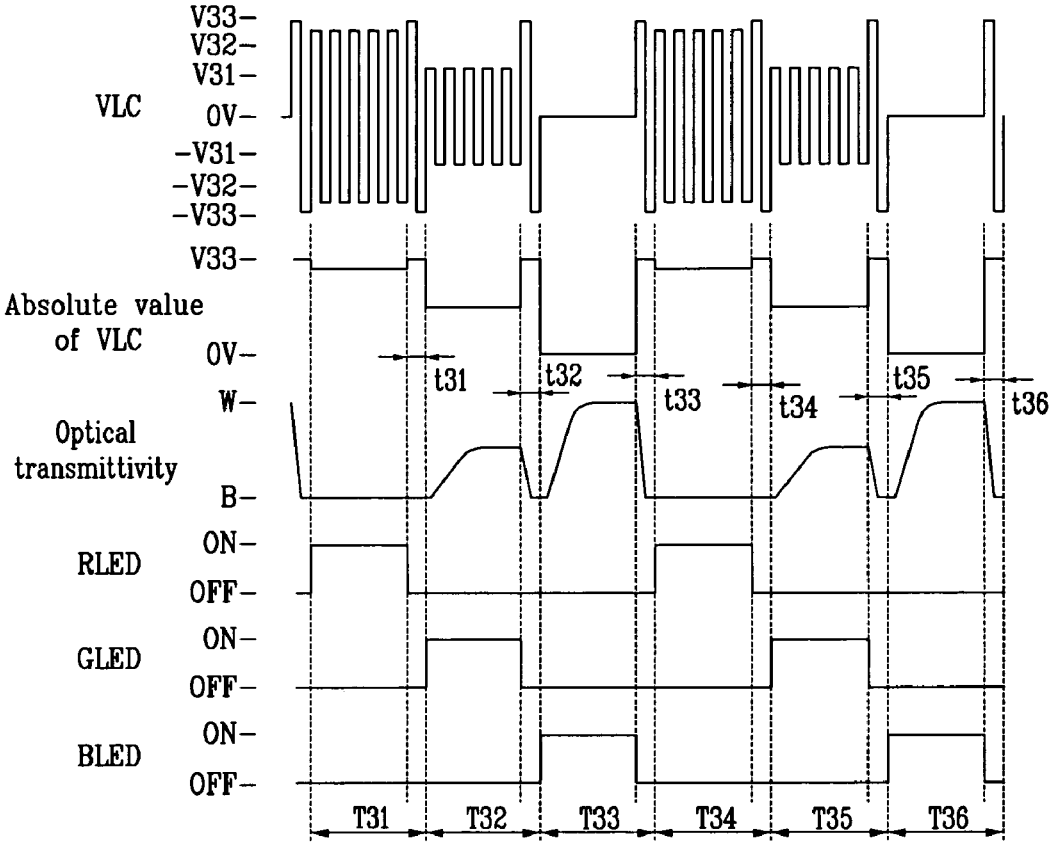
FIG. 4 shows a waveform which illustrates a reset driving method of a conventional liquid crystal display device.

In contrast, according to the conventional driving method shown in FIG. 4, a constant reset voltage is applied regardless of the data voltage applied to the previous pixel, and enough reset voltage to reset all liquid crystals is applied. The problem with such a method of applying a constant reset voltage is that consumption of power by the reset voltage is increased.

However, according to the first exemplary embodiment, different sizes of reset voltages are applied based on data voltages applied to previous pixels, and consumption of power by the reset voltage can therefore be reduced or minimized.

FIGS. 7 and 8 show a liquid crystal display for applying a reset voltage according to the first exemplary embodiment.

As shown in FIG. 7, a liquid crystal display according to the first exemplary embodiment includes a liquid crystal display panel 100, a scan driver 200, a data driver 300, a gray voltage generator 400, a timing controller 500, a reset voltage generator 600, emission diodes 700*a*, 700*b*, and 700*c* outputting R, G, and B lights respectively, and a light source controller 800.

In the liquid crystal display panel 100, a plurality of scan lines 102 are formed, and data lines 102 that are insulated and crossing the plurality of scan lines for transferring gray data and reset voltages are formed. A plurality of pixels 110 arranged in a matrix format are respectively surrounded by scan lines and data lines, each pixel including a thin film transistor (not shown) of which a corresponding scan line and a corresponding data line are respectively connected to a gate electrode and a source electrode, and a pixel capacitor (not shown) and a storage capacitor (not shown) connected to a drain electrode of the thin film transistor.

The scan driver 200 sequentially applies scan signals to scan lines, allowing the TFTs of which gate electrodes are connected to the scan lines to be turned on. According to the exemplary embodiment, first, the scan driver 200 sequentially applies scan signals for applying a reset voltage to the plurality of scan lines so as to erase an effect of a data voltage applied to a previous pixel, and sequentially applies scan signals for applying data voltages to the plurality of scan lines.

The timing controller 500 receives gray data signals R, G, and B data, and horizontal synchronizing signals (Hsync) and vertical synchronizing signals (Vsync), and supplies necessary control signals Sg, Sd, and Sb to the scan driver 200, the data driver 300, and the light source controller 800, respectively, and supplies gray data R, G, and B data to the gray voltage generator 400 and the reset voltage generator 600.

The gray voltage generator 400 generates gray voltages corresponding to gray data which is supplied to the data driver 300. The reset voltage generator 600 selects reset voltages corresponding to the gray voltages to be applied to a previous pixel, and supplies the selected voltage to the data driver 300. The data driver 300 applies gray voltages outputted from the gray voltage generator 400, or reset voltages outputted from the reset voltage generator 600, to corresponding data lines.

The emission diodes 700*a*, 700*b*, and 700*c* output light corresponding to each R, G, and B to the LCD panel 100, and the light source controller 800 controls lighting time of the emission diodes 700*a*, 700*b*, and 700*c*. According to the exemplary embodiment, points of time for supplying corresponding gray data to the data lines and lighting R, G, and B emission diodes by the light source controller 800 can be synchronized with control signals provided from the timing controller 500.

As shown in FIG. 8, the reset voltage generator 600 according to the first exemplary embodiment includes a memory 620, a reset voltage selector 640, a switch 660, and a constant voltage generator 680.

The memory 620 stores gray data corresponding to a previous pixel and reset voltage values corresponding to the previous pixel.

The reset voltage selector 640 reads reset voltage values corresponding to gray data R, G, and B of the previous pixel stored in the memory 620, and controls operation of the switch 660.

The constant voltage generator 680 generates reset voltages Vr1, Vr2, and 0V which are supplied to the switch 660.

The switch 660 selects one reset voltage of a plurality of reset voltages outputted from the constant voltage generator 680 according to control operation of the reset voltage selector 640, which is outputted to the data driver 300.

According to the first exemplary embodiment, the reset voltage generator 600 generates different sizes of reset voltages based on data voltages applied to previous pixels, and the data driver 300 applies reset voltages corresponding to previous gray data outputted from the reset voltage generator 600 to data lines. Thus, the most suitable voltage for reset can be applied so that power consumption by reset voltages can be reduced.

Next, a driving method according to the second exemplary embodiment is disclosed in reference to FIGS. 9~12. A driving method of the second exemplary embodiment relates to a reset driving method applied to a field sequential driving method of a digital method.

Figure 9:
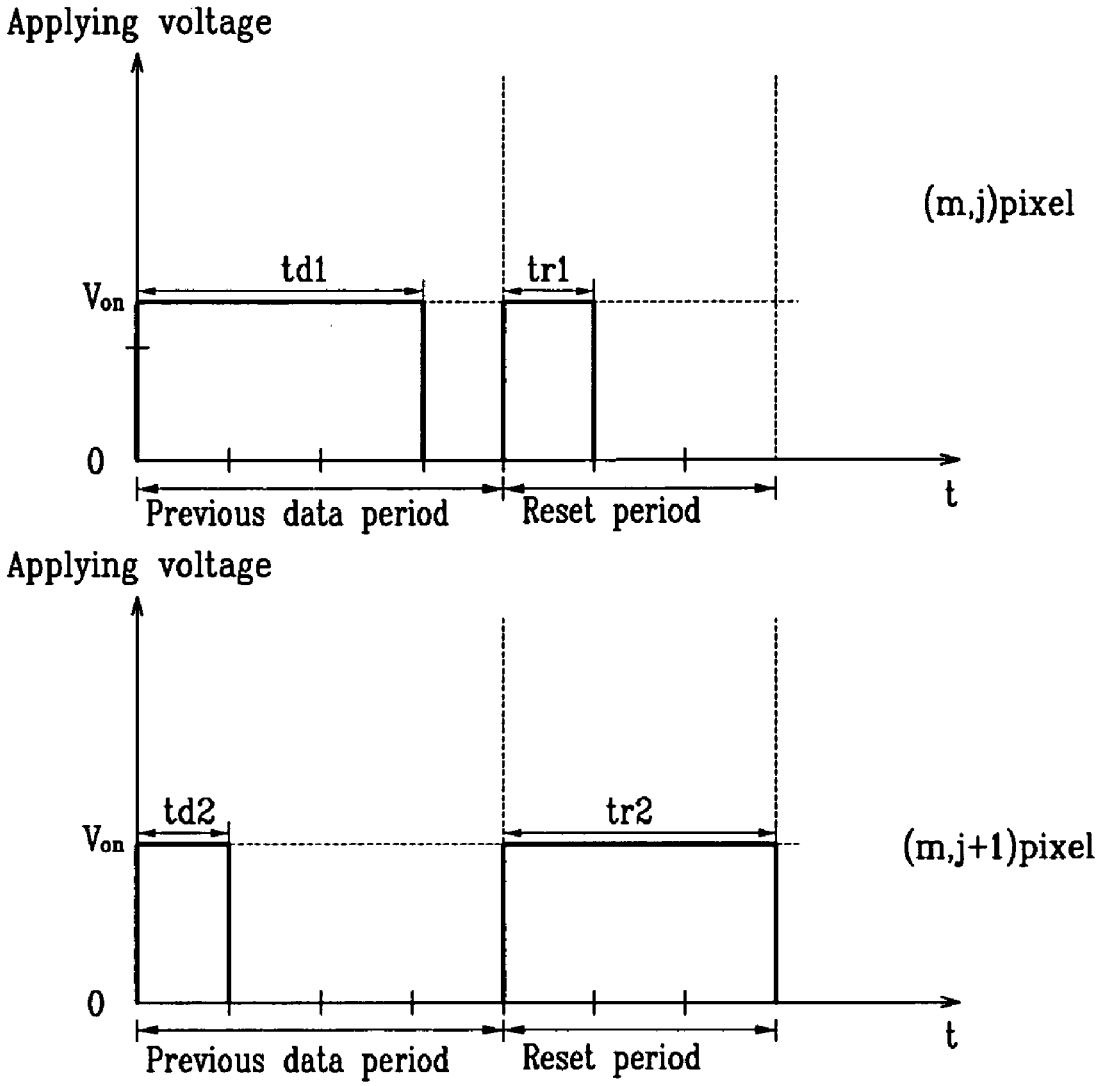
FIG. 9 shows a driving method of a liquid crystal display according to a second exemplary embodiment.

Referring to FIG. 9, the width of a reset waveform (tr1) applied to an (m,j) pixel (that is, a pixel corresponding to the Dm data line and the Sj scan line) and the width of a reset waveform (tr2) applied to an (m,j+1) pixel (that is, a pixel corresponding to the Dm data line and the Sj+1 scan line) for displaying the present R light depend on gray waveforms applied to a previous pixel (for example, a pixel for displaying B light).

In detail, according to the second exemplary embodiment, in the normally white mode, in the case a waveform with a large voltage width is applied to a previous pixel, the state of the liquid crystal is turned to a state such that a relatively lesser amount of light can transmit than with a waveform to which a small voltage width is applied, thus a waveform with a small voltage width can be applied.

And in the case a waveform of an appropriate large width is applied to a previous pixel, and thus the liquid crystal is almost in a black state at the end of a period for applying data voltage, it may not be necessary to apply a reset waveform.

According to the second exemplary embodiment, different widths of reset waveforms are applied based on a width (or pattern) of a gray waveform applied to a previous pixel, and hence consumption of power by reset waveforms can be reduced or minimized.

Figure 10:
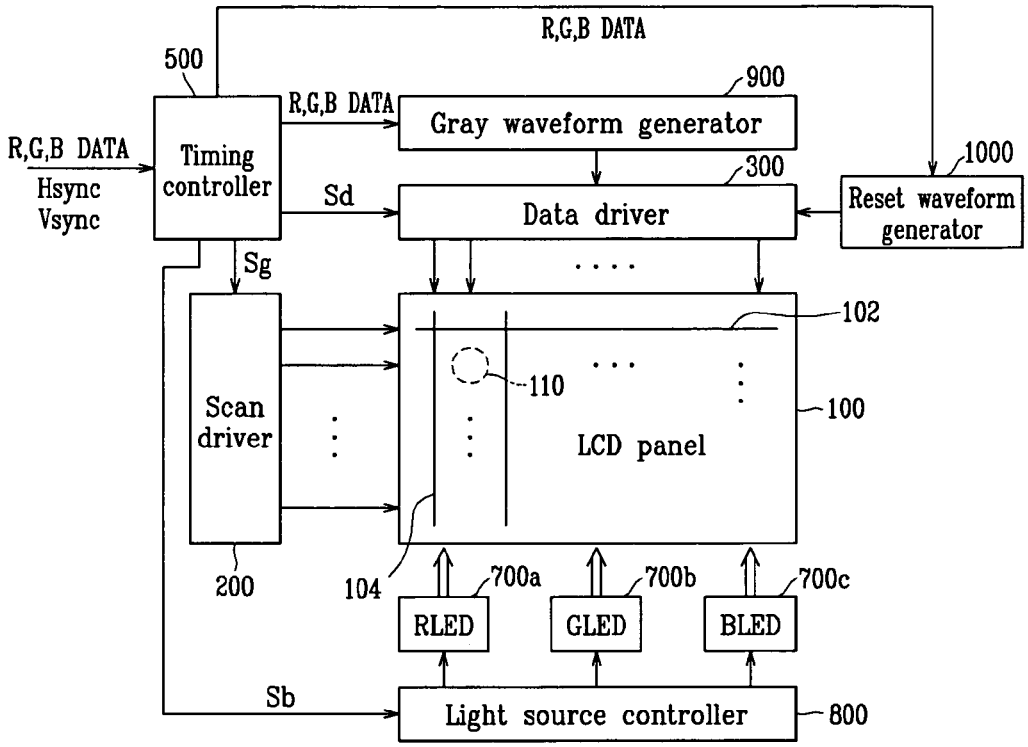
FIGS. 10~12 show a liquid crystal display according to the second exemplary embodiment.
Figure 11:
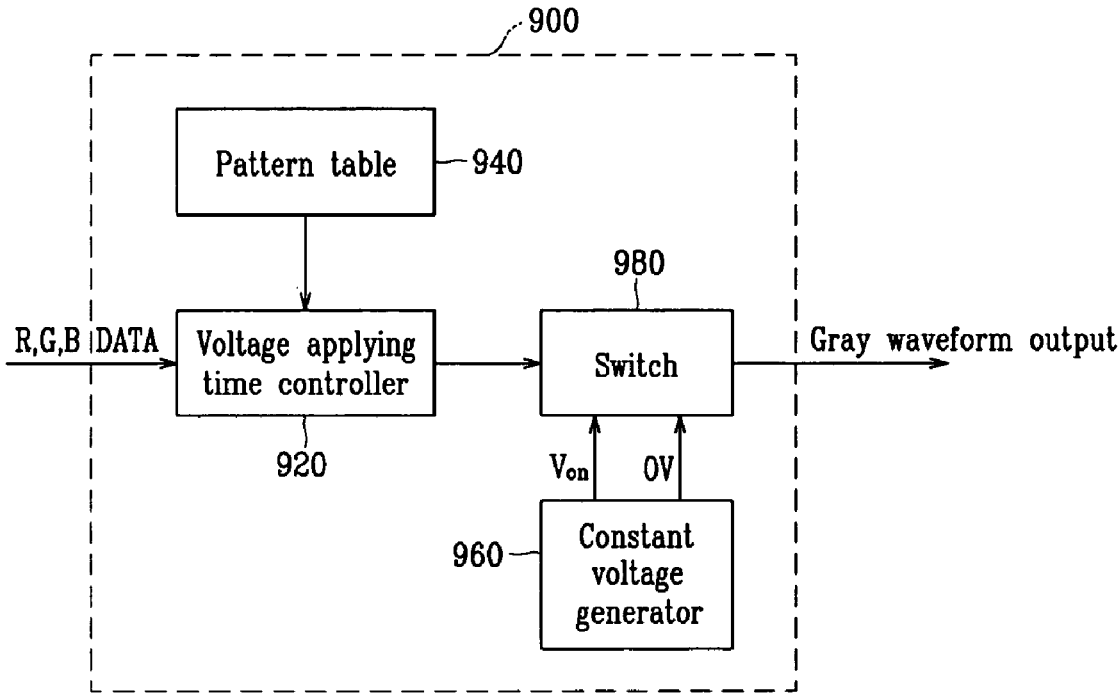
Figure 12:
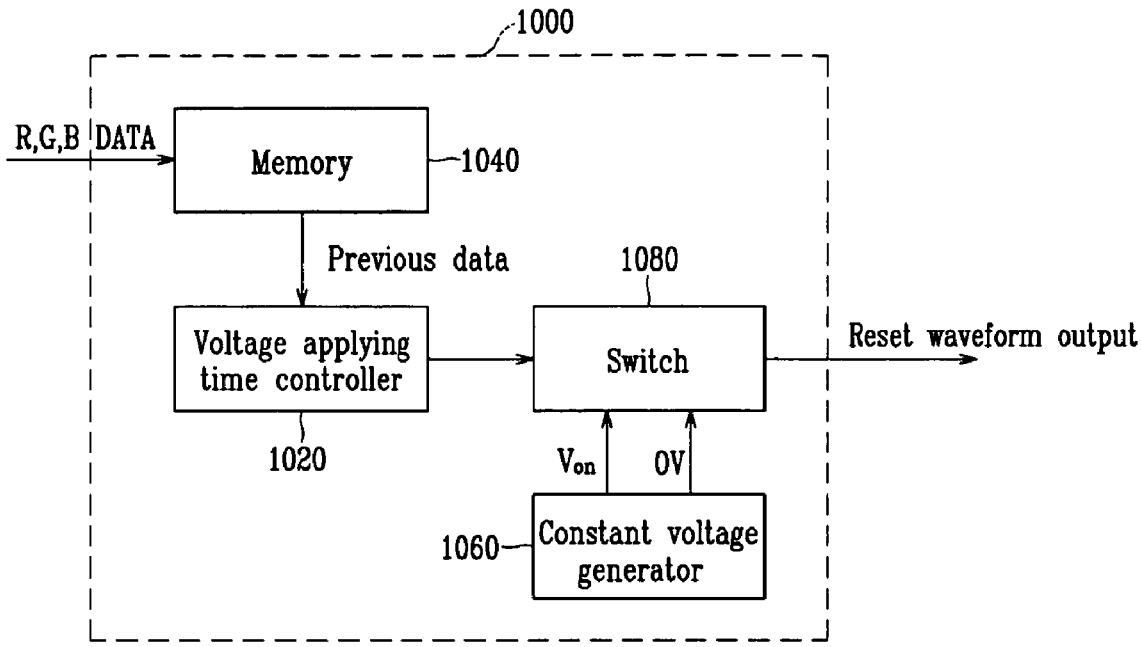

FIGS. 10~12 show a liquid crystal display for applying a reset waveform according to the second exemplary embodiment. In a liquid crystal display according to the second exemplary embodiment shown in FIG. 10, parts that are the same as parts of a liquid crystal display according to the first exemplary embodiment shown in FIG. 7 have the same reference numerals, and redundant explanations are not provided.

In FIG. 10, a gray waveform generator 900 generates a gray waveform having a voltage width corresponding to gray data (i.e., R, G, B data), and supplies the gray waveform to the data driver 300. The reset waveform generator 1000 generates reset waveforms corresponding to gray waveforms applied to a previous pixel and supplies the generated reset waveforms to the data driver 300. The data driver 300 applies a gray waveform outputted by the gray waveform generator 900, or a reset waveform outputted by the reset waveform generator 1000 to corresponding data lines.

FIGS. 11 and 12 respectively show the gray waveform generator 900 and the reset waveform generator 1000 according to the secondary exemplary embodiment.

As shown in FIG. 11, the gray waveform generator 900 according to the second exemplary embodiment includes a voltage applying time controller 920, a pattern table 940, a constant voltage generator 960, and a switch 980.

The pattern table 940 stores gray waveform patterns (on/off patterns) corresponding to gray data. According to the exemplary embodiment of the present invention, the pattern table stores a 4 bit on/off pattern corresponding to 6 bit gray data. For example, according to the exemplary embodiment, the pattern table stores 1011 on/off patterns (here, "1" is on waveform, and "0" is off waveform) corresponding to 6 bit gray data of 101111.

The voltage applying time controller 920 extracts gray waveform patterns (on/off patterns) corresponding to input gray data R, G, and B from the pattern table, and controls on/off operation and on/off time of the switch 980 based on extracted gray waveform pattern. In detail, the voltage applying time controller 920 controls the switch 980 to allow the first voltage (Von) to be applied so as to turn on the state of liquid crystal during the predetermined time, when the extracted gray waveform patterns (on/off) pattern value is "1". Further, the voltage applying time controller 920 controls the switch 980 to allow the second voltage (0 V) to be applied so as to turn off the state of liquid crystal, when the extracted gray waveform patterns (on/off) pattern value is "0". The constant voltage generator 960 generates the first voltage (Von) and the second voltage (0 V) which are supplied to the switch 980.

The switch 980 selects the first voltage or the second voltage outputted from the constant voltage generator 960 based on a control operation of the voltage applying time controller 920, and outputs a corresponding gray waveform to the data driver 300.

As shown in FIG. 12, the reset waveform generator 1000 according to the second exemplary embodiment includes a memory 1040, a voltage applying time controller 1020, a constant voltage generator 1060, and a switch 1080.

The memory 1040 stores gray data corresponding to a previous pixel, and a reset waveform corresponding to previous gray data. According to the exemplary embodiment, the memory 1040 stores a 3 bit reset waveform pattern (on/off pattern) corresponding to 6 bit gray data. For example, according to the exemplary embodiment, the memory stores an on/off pattern 100 (here, "11" is on waveform, and "0" is off waveform) corresponding to 6 bit gray data of 101111.

The voltage application controller 1020 reads reset waveform patterns (on/off pattern) corresponding to gray data R, G, and B of a previous pixel stored in the memory 1040, and controls an on/off operation and an on/off time of the switch 1080 according to the on/off pattern read. The switch 1080 and the constant voltage generator 1060 shown in FIG. 12 operate in similar manner as the corresponding elements shown in FIG. 11. Therefore, redundant explanations are not provided.

Figure 13:
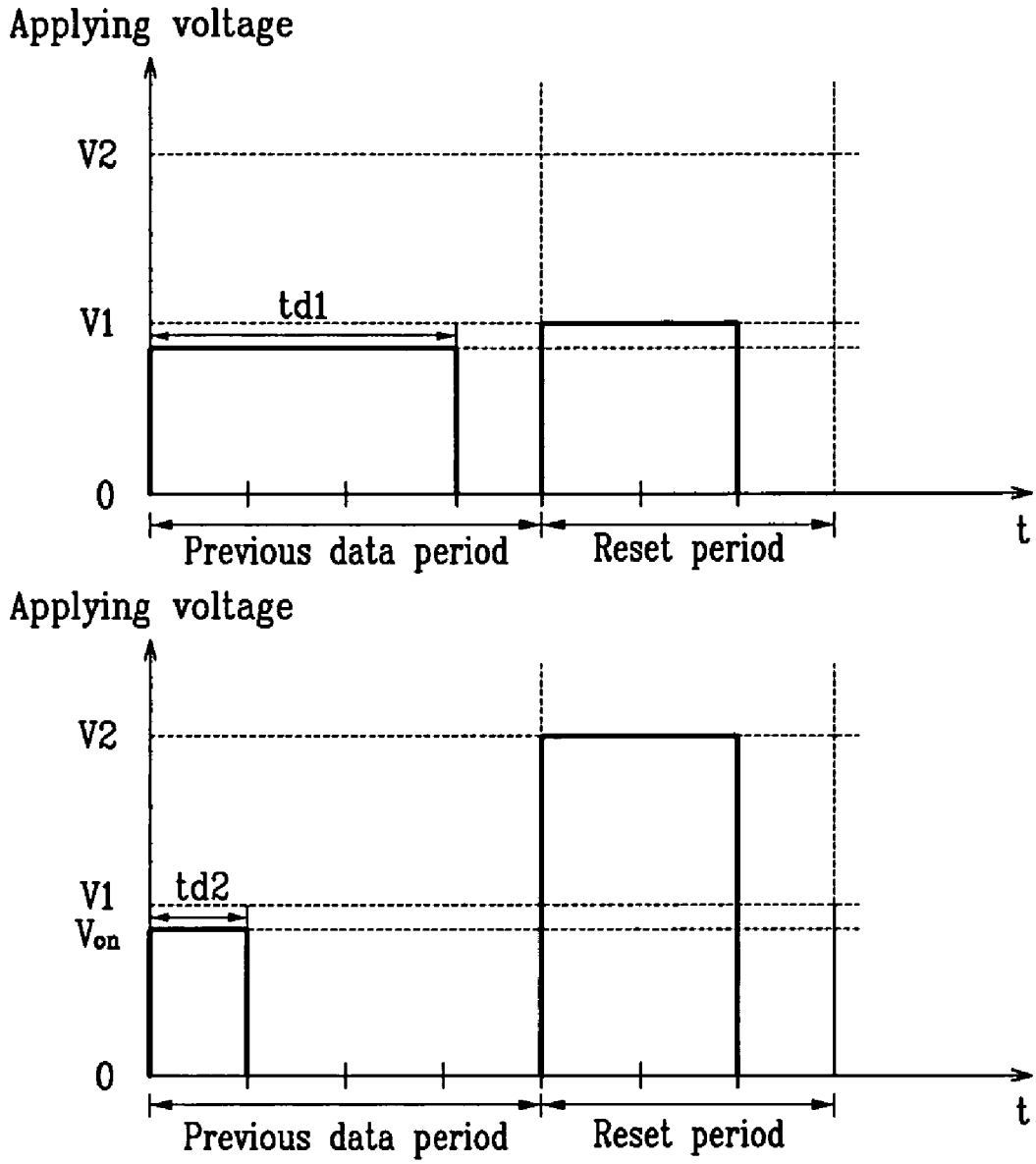
FIG. 13 shows a driving method of a liquid crystal display according to a third exemplary embodiment.

Next, a driving method according to a third exemplary embodiment is described in reference to FIG. 13. The driving method of the third exemplary embodiment relates to a reset driving method applied to a field sequential driving method of a digital method.

Referring to FIG. 13, a voltage (V1) applied to an (m,j) pixel (that is, a pixel corresponding to the Dm data line and the Sj scan line) and a reset voltage (V2) applied to an (m,j+1) pixel (that is, a pixel corresponding to the Dm data line and the Sj+1 scan line) for displaying a present R light depend on gray waveforms applied to a previous pixel (for example, a pixel for displaying B light).

In detail, according to the third exemplary embodiment, in a normally white mode, in the case a large voltage width (td1) is applied to a previous pixel, the state of liquid crystal is turned to a state in which relatively lesser light can transmit than with a waveform with a small voltage width (td2) applied, thus a reset waveform with small voltage (V1) can be applied.

Further, in the case a gray waveform with an appropriate large width is applied to a previous pixel, and thus the liquid crystal is almost in a black state at the end of a period for applying the data voltage, the reset voltage may not need to be applied.

According to the third exemplary embodiment, different sizes of reset voltages are applied based on a width (or pattern) of the gray waveform applied to a previous pixel, and consumption of power by reset voltages can therefore be reduced or minimized.

Figure 14:
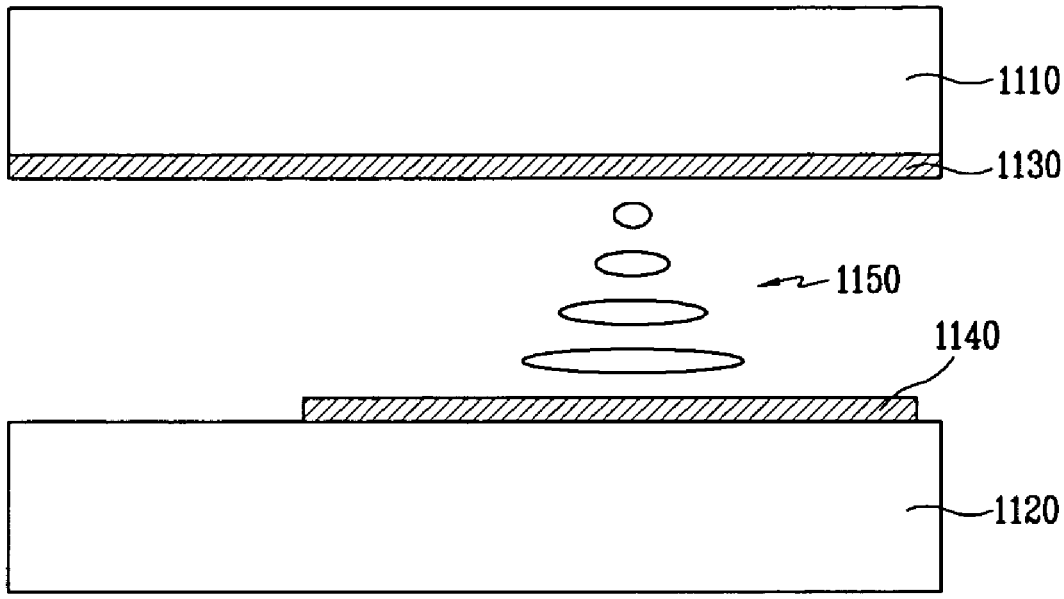
FIG. 14 illustrates a conceptual diagram of a pixel of a TFT-LCD.

FIG. 14 illustrates a conceptual diagram of a pixel of a TFT-LCD. The pixel includes a liquid crystal 1150 disposed between a first substrate 1110 and a second substrate 1120, a first electrode (common electrode) 1130 arranged at the first substrate 1110, and a second electrode (pixel electrode) 1140 arranged at the second substrate 1120. Exemplary embodiments of the present invention can be applied to the pixel of FIG. 14, as well as other suitable pixels. In addition, the first and second substrates 1110, 1120 and the liquid crystal 1150 may be equivalently represented, for example, as the liquid crystal capacitor Cl in FIG. 1.

While the present invention has been described in connection with certain exemplary embodiments, it is to be understood that the present invention is not limited to the disclosed embodiments, but, on the contrary, is intended to cover various modifications and equivalent arrangements included within the spirit and scope of the appended claims, and equivalents thereof.

What is claimed is:

1. A driving method of a liquid crystal display wherein liquid crystal is disposed between a first substrate and a second substrate, and first, second, and third color lights are sequentially transmitted for each of a plurality of pixels, comprising:

(a) applying a first voltage corresponding to first gray data to a first said pixel;

(b) applying a second voltage corresponding to second gray data to a second said pixel;

(c) applying a first reset voltage corresponding to the first gray data to the first said pixel after step (a); and (d) applying a second reset voltage to the second said pixel after step (b), the second reset voltage corresponding to the second gray data and having a voltage level which is different from that of the first reset voltage, wherein the absolute value of the first reset voltage is less than the absolute value of the second reset voltage when the absolute value of the first gray voltage is greater than the absolute value of the second gray voltage.

2. The driving method of a liquid crystal display of claim 1, wherein the first color, second color, and third color are red color, green color, blue color, respectively.

3. A driving method of a liquid crystal display wherein liquid crystal is disposed between a first substrate and a second substrate, and first, second, and third color lights are sequentially transmitted for each of a plurality of pixels, comprising:

(a) applying a first voltage corresponding to first gray data to a first said pixel; and (b) applying a first reset voltage corresponding to the first gray data to the first said pixel after step (a) to reset a state of the liquid crystal of the first said pixel to a desired state, wherein in step (b), the first reset voltage corresponding to the first gray data is applied when the first gray voltage is less than a reference voltage, and no reset voltage is applied when the first gray voltage is greater than the reference voltage.

4. The driving method of a liquid crystal display of claim 3, wherein the desired state of the liquid crystal is a state in which optical transmittivity is approximately zero.

5. The driving method of a liquid crystal display of claim 3, wherein the reference voltage is a voltage which makes the optical transmittivity to be approximately zero.

6. A driving method of a liquid crystal display wherein liquid crystal is disposed between a first substrate and a second substrate, and first, second, and third color lights are sequentially transmitted for each of a plurality of pixels, comprising:

(a) applying a first voltage corresponding to first gray data to a first said pixel; and (b) applying a first reset voltage corresponding to the first gray data to the first said pixel after step (a) to reset a state of the liquid crystal of the first said pixel to a desired state, wherein step (b) comprises:

selecting the first reset voltage from among at least two reset voltages in response to the first gray data; and supplying the first reset voltage to the first said pixel.

7. A driving method of a liquid crystal display wherein liquid crystal is disposed between a first substrate and a second substrate, and first, second, and third color lights are sequentially transmitted for each of a plurality of pixels, comprising:

(a) applying a first waveform corresponding to first gray data to a first said pixel;

(b) applying a second waveform corresponding to second gray data to a second said pixel;

(c) applying a first reset waveform corresponding to the first gray data to the first said pixel after step (a; and (d) applying a second reset waveform to the second said pixel after step (b), the second reset waveform corresponding to the second gray data and being different from the first reset waveform, wherein a width of the first reset waveform is different from that of the second reset waveform.

8. The driving method of a liquid crystal display of claim 7, wherein the width of the first reset waveform is less than that of the second reset waveform when a width of the first waveform is greater than that of the second waveform.

9. The driving method of a liquid crystal display of claim 7, wherein the first color, second color, and third color are red color, green color, blue color, respectively.

10. A driving method of a liquid crystal display wherein liquid crystal is disposed between a first substrate and a second substrate, and first, second, and third color lights are sequentially transmitted for each of a plurality of pixels, comprising:

(a) applying a first waveform corresponding to first gray data to a first said pixel;

(b) applying a second waveform corresponding to second gray data to a second said pixel;

(c) applying a first reset waveform corresponding to the first gray data to the first said pixel after step (a); and (d) applying a second reset waveform to the second said pixel after step (b), the second reset waveform corresponding to the second gray data and being different from the first reset waveform, wherein the absolute value of a voltage level of the first reset waveform is different from the absolute value of a voltage level of the second reset waveform.

11. The driving method of a liquid crystal display of claim 10, wherein the voltage level of the first reset waveform is less than the voltage level of the second reset waveform when a width of the first waveform is greater than that of the second waveform.

12. A driving method of a liquid crystal display wherein liquid crystal is disposed between a first substrate and a second substrate, and first, second, and third color lights are sequentially transmitted for each of a plurality of pixels, comprising:

(a) applying a first waveform corresponding to first gray data to a first said pixel; and (b) applying a first reset waveform corresponding to the first gray data to the first said pixel after step (a) to reset a state of the liquid crystal of the first said pixel to a desired state, wherein in step (b), the reset waveform corresponding to the first gray data is applied when a width of the first waveform is less than that of a reference width, and no reset waveform is applied when the width of the first waveform is greater than the reference width.

13. The driving method of a liquid crystal display of claim 12, wherein the desired state of the liquid crystal is a state in which optical transmittivity is approximately zero.

14. The driving method of a liquid crystal display of claim 12, wherein the reference width is a width which makes optical transmittivity of the liquid crystal to be approximately zero.

15. A driving method of a liquid crystal display which includes a plurality of scan lines, a plurality of data lines insulated and crossing the scan lines, a plurality of pixels arranged in a matrix format and being formed at areas surrounded by the scan lines and the data lines, and including switches coupled to the scan lines and the data lines, respectively, and which sequentially transmit red, blue, and green lights for each said pixel, wherein the driving method comprises transmitting the red, green, and blue lights during a red field, a green field and a blue field, respectively, the red field, the green field, and the blue field each comprising:

a reset period for sequentially driving the scan lines and applying a reset voltage or a reset waveform corresponding to gray data applied during a previous said field;

a data applying period for sequentially driving the scan lines and applying a gray voltage or a gray waveform corresponding to gray data; and selecting the reset voltage corresponding to the gray data applied to a first said pixel during the previous said field from among at least two reset voltages having voltage levels with different absolute values, and applying the reset voltage to the first said pixel during the reset period.

16. A driving method of a liquid crystal display which includes a plurality of scan lines, a plurality of data lines insulated and crossing the scan lines, a plurality of pixels arranged in a matrix format and being formed at areas surrounded by the scan lines and the data lines, and including switches coupled to the scan lines and the data lines, respectively, and which sequentially transmit red, blue, and green lights for each said pixel, wherein the driving method comprises transmitting the red, green, and blue lights during a red field, a green field and a blue field, respectively, the red field, the green field, and the blue field each comprising:

a reset period for sequentially driving the scan lines and applying a reset voltage or a reset waveform corresponding to gray data applied during a previous said field;

a data applying period for sequentially driving the scan lines and applying a gray voltage or a gray waveform corresponding to gray data; and selecting the reset waveform corresponding to the gray data applied to a first said pixel during the previous said field from among at least two reset waveforms having different widths, and applying the reset waveform to the first said pixel during the reset period.

17. A liquid crystal display comprising:

a liquid crystal display panel comprising a plurality of scan lines for transferring scan signals, a plurality of data lines insulated and crossing the scan lines, and a plurality of pixels arranged in a matrix format and formed at areas surrounded by the scan lines and the data lines, and including switches coupled to the scan lines and the data lines;

a scan driver for sequentially supplying the scan signals to the scan lines;

a gray voltage generator for generating a gray voltage corresponding to gray data;

a reset voltage generator for generating a reset voltage corresponding to a gray voltage applied to a previous said pixel;

a data driver for supplying the gray voltage and the reset voltage respectively outputted by the gray voltage generator and the reset voltage generator to corresponding said data lines; and a light source for sequentially outputting a first color light, a second color light, and a third color light for each said pixel.

18. A liquid crystal display of claim 17, wherein the reset voltage generator comprises:

a memory for storing the gray data corresponding to the previous said pixel and a reset voltage value corresponding to the gray data of the previous said pixel;

a constant voltage generator for generating at least two reset voltages having different voltage levels;

a switch for selecting one said reset voltage from among the at least two reset voltages generated by the constant voltage generator; and a reset voltage selector for reading the reset voltage value corresponding to the gray data of the previous said pixel from the memory, and controlling an operation of the switch based on the reset voltage value which is read.

19. A liquid crystal display comprising:

a liquid crystal display panel comprising a plurality of scan lines for transferring scan signals, a plurality of data lines insulated and crossing the scan lines, a plurality of pixels arranged in a matrix format and formed at areas surrounded by the scan lines and the data lines, and including switches coupled to the scan lines and the data lines;

a scan driver for sequentially supplying the scan signals to the scan lines;

a gray waveform generator for generating a gray waveform corresponding to gray data;

a reset waveform generator for generating a reset waveform corresponding to a gray waveform applied to a previous said pixel;

a data driver for supplying the gray waveform and the reset waveform respectively outputted by the gray waveform generator and the reset waveform generator to corresponding said data lines; and a light source for sequentially outputting a first color light, a second color light, and third color light for each said pixel.

20. The liquid crystal display of claim 19, wherein the gray waveform generator comprises:

a pattern table for storing gray waveform patterns corresponding to gray data;

a constant voltage generator for generating a first voltage and a second voltage;

a switch for selecting one of the first voltage and the second voltage; and a voltage applying time controller for extracting one of the gray waveform patterns, which corresponds to the gray data from the pattern table, and controlling the operation of the switch based on the extracted one of the gray waveform patterns.

21. The liquid crystal display of claim 19, wherein the reset waveform generator comprises:

a memory for storing gray data corresponding to a previous said pixel and a reset waveform pattern corresponding to the gray data of the previous said pixel;

a constant voltage generator for generating a first voltage and a second voltage;

a switch for selecting one of the first voltage and the second voltage; and a voltage applying time controller for reading the reset waveform pattern corresponding to the gray data of the previous said pixel, and controlling the switch based on the reset waveform pattern which is read.

* * * * *

UNITED STATES PATENT AND TRADEMARK OFFICE

CERTIFICATE OF CORRECTION

PATENT NO. : 7,429,971 B2
APPLICATION NO. : 10/980686
DATED : September 30, 2008
INVENTOR(S) : Jun-Ho Park It is certified that error appears in the above-identified patent and that said Letters Patent is hereby corrected as shown below:

In the Claims

Column 11, line 46, Claim 7 Delete "(a; and,"
Insert --(a); and--

Signed and Sealed this

Sixth Day of January, 2009

JON W. DUDAS
*Director of the United States Patent and Trademark Office*